United States Patent [19]

Johnson et al.

[11] Patent Number: 4,550,467

[45] Date of Patent: Nov. 5, 1985

[54] BOWLING LANE DUSTER

[75] Inventors: Richard H. Johnson, Muskegon; George A. Muma, Casnovia, both of Mich.

[73] Assignee: Brunswick Corporation, Skokie, Ill.

[21] Appl. No.: 357,603

[22] Filed: Mar. 12, 1982

[51] Int. Cl.[4] ..... A47L 13/24

[52] U.S. Cl. ..... 15/228; 15/99; 15/233

[58] Field of Search ..... 15/98, 99, 228, 231, 15/232, 233, 51; 118/257

[56] References Cited

U.S. PATENT DOCUMENTS

| | | | |
|---|---|---|---|
| 1,995,685 | 3/1935 | Perkins | 15/98 |
| 2,394,585 | 2/1946 | Bailey | 15/98 |
| 2,601,537 | 6/1952 | Lofgren | 15/231 |
| 2,690,582 | 10/1954 | Sundell | 15/228 |
| 2,828,501 | 4/1958 | Brown, Sr. | 15/231 X |
| 3,116,504 | 1/1964 | Unterbrink et al. | 15/231 |
| 3,377,640 | 4/1968 | Rudolph | 15/99 |
| 4,106,153 | 8/1978 | Lemelson | 15/231 |
| 4,121,315 | 10/1978 | Buser | 15/228 |

*Primary Examiner*—Edward L. Roberts

*Attorney, Agent, or Firm*—Wood, Dalton, Phillips, Mason & Rowe

[57] ABSTRACT

A bowling lane cleaning apparatus serving as a lane duster, including a rigid frame having a transversely disposed spacer bar with a foam padded bar disposed beneath the spacer bar. The padded bar works in conjunction with cloth roller bars to provide adequate wide area exposure of cloth fabric to the bowling lane surface.

15 Claims, 5 Drawing Figures

BOWLING LANE DUSTER

FIELD AND BACKGROUND OF THE INVENTION

This invention relates to bowling lane maintenance devices and, more particularly, to dual roller surface contact bowling lane dusters.

Bowling lane dusters are used to clean lanes, removing and spreading conditioner uniformly so when bowling play is resumed, a new film of conditioner will have been applied to the surface of the bowling lane. Consistent bowling surfaces are desirable to achieve some degree of consistency in the game of bowling. Conditioning a lane to allow consistency of play involves spreading an oil film on the surface. In time the surface picks up dirt and dust and the oil is transported from one area to another. It thus becomes regularly necessary to clean off the surface of a bowling lane and recondition it.

A bowling lane duster may have a roller that supplies a clean cloth fabric and a pick-up roller that takes up the dirty cloth. A rachet may be used to advance the roll cloth in preset amounts to allow fresh cloth to be applied to the surface of a bowling lane.

Previously conventional bowling lane dusters tended to bridge across dished bowling lanes and did not effectively clean the center of the lane.

An object of the invention is to account for this concavity of the bowling lane surface, while increasing the surface area of the cloth exposed to the lane conditioner.

It is a further object of the invention to increase the surface area of the exposed surface of the cloth so that more removal of lane conditioner can occur.

Another object of the invention includes designing a lane duster which does not have to be turned around in direction when a sweep back along the bowling lanes is made. This and other objects of the invention will become apparent.

The current art appears to provide a foam pad on a single bar with a singular lane contact. The present art also provides two cloth rollers in bilateral contact with the lane surface. The current art does not provide a design which combines the dual roller benefit with the foam pad.

SUMMARY OF THE INVENTION

A lane duster having a padded flexible material such as polyurethane foam set in place on a bar within the lane duster frame acting in cooperation with a cloth covered roller. The presence of this bar allows additional surface exposure of the cleaning cloth.

BRIEF DESCRIPTION OF THE DRAWINGS

The details of construction and operation of the invention are more fully described with reference to the accompanying drawings which form a part hereof and which like reference numerals refer to parts throughout. In the drawings.

DESCRIPTION OF THE PREFERRED EMBODIMENT

Figure 1:
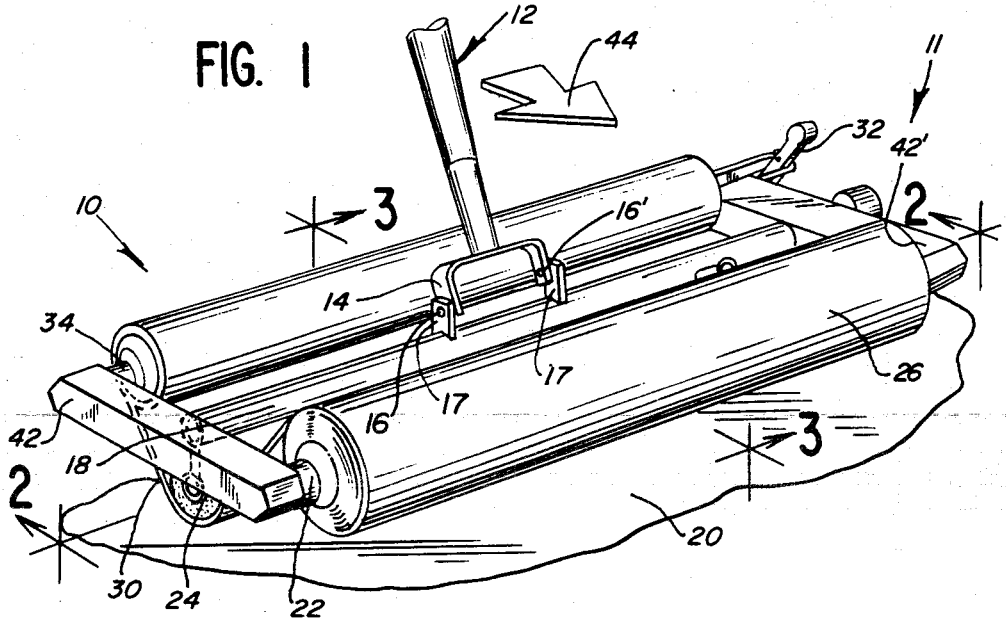
FIG. 1 is a perspective view of an improved lane duster incorporating a padded center bar.

In a preferred form of the invention, FIG. 1 shows a lane duster assembly 10 which comprises a handle 12 which may be of wood, aluminum or other appropriate material, hinged by a clevis 14 and a pair of pins 16,16' to lugs 17 on a central spacer bar 18. The handle may be pivoted freely on either side of a vertical plane of the assembly 10. Lane duster frame 11, shown generally in FIG. 1 and in more detail in FIG. 5, comprises the central spacer bar 18 and dual spaced apart roller bars 22 and 34, which extend between end castings 42, 42'. Casting 42 is secured rigidly to spacer bar 18 and has pins 19 projecting from each extremity thereof toward the casting 42'. Casting 42' is removably secured to the other end of spacer bar 18 and has one pin 19' projecting toward casting 42 from one end portion of the casting 42'. The other end portion of casting 42' has a ratchet lever 32, ratchet 33, a connector 35 and a pin 19', all of which are well known in the art and which lock to one end of the roller 34.

A hand know 48 is threaded on a rod 49 with the rod projecting into the bar 18, with said rod 49 having a transverse pin 47 at its distal end. The pin 47 slides in longitudinal slots 51 in the bar 18. A spring 52 between the pin 47 and the casting 42' preloads the knob 48. With the roller 22 between castings 42,42' and engaging aligned pins 19,19' and with the roller 34 between the castings 42,42' and engaging one pin 19 and the connector 35 and pin 19', the knob 48 may be tightened on the rod 49 to apply a braking force (a resistance to rotation) to the roller 22 and connects the ratchet 33 to the roller 34 so that roller 34 can only rotate in the direction of rotation of the ratchet, and only then when the ratchet is actuated.

Figure 2:
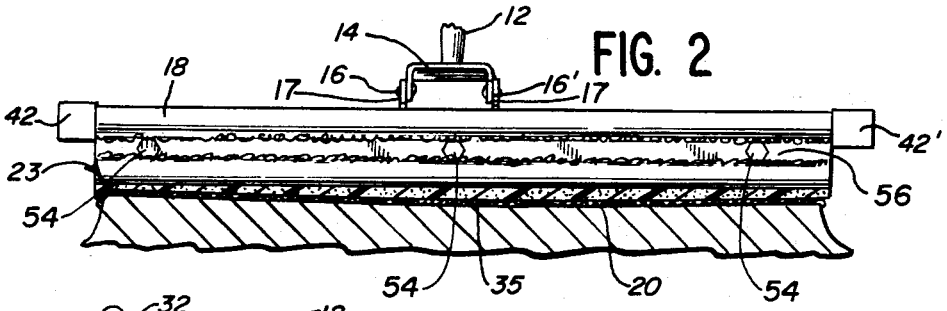
FIG. 2 is a cross sectional view of the lane duster taken along lines 2—2 of FIG. 1.
Figure 3:
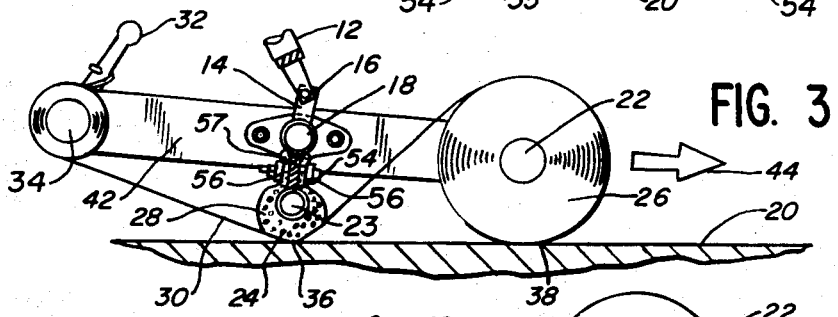
FIG. 3 is a side view of the lane duster taken along lines 3—3 of FIG. 1 with the lane duster being pushed in a forward direction.

A cloth fabric 30, capable of absorbing and removing dust from the bowling lane surface 20, is loaded in a roller configuration 26 around roller bar 22. FIG. 2 illustrates an important feature of the invention, wherein a tube 23, of substantially the same width as the width of the cloth on roller 22, is encased in foam pad 24, which pad 24 is surrounded by a polyethylene film 28. The film 28 acts as an antifriction surface as will be described hereinafter. The tube 23 is shown suspended below the spacer bar 18 by rigidly clamping a pair of spaced apart downwardly depending lugs 56 on the spacer bar 18 to an upwardly extending plate 57 on the tube 23. In the illustrated embodiment, bolts and nuts 54 pass through the interfitting lugs 56 and plate 57 to clamp the tube to the frame 11. The cloth fabric 26 is loaded on the roller 22 in a direction to permit counterclockwise dispensing of the fabric from the roller 22, as shown in FIG. 3. The fabric 30 leaves the top of the rolled configuration 26 and is threaded below spacer bar 18, under foam pad 24, and on to take up roller 34. Rollers 22 and 34, together with spacer bar 18 and tube 23, are mounted parallel to each other and are connected to the end castings 42 and 42' to form the duster frame 11. The length of the rollers 22 and 34 is generally great enough to allow the lane duster to span across the complete width, gutter to gutter, of a standard bowling lane. The lower surface of the foam pad 24 lies in a plane below the plane of the roller bars 22, 34 not only when either roller bar 22 or 34 is fully loaded with cloth fabric 30, but also when either roller bar 22 or 34 is fully empty.

Figure 4:
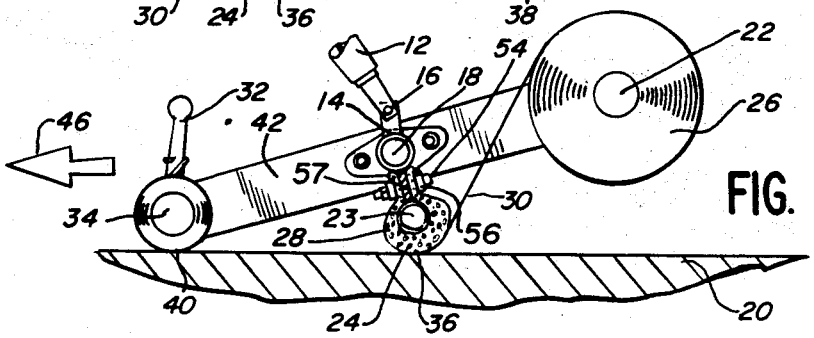
FIG. 4 is a side view similar to FIG. 3 of the lane duster showing the lane duster pulled in a reverse direction.

The cloth fabric 30 is placed under tension between the roller bars 22 and 34 and below the foam pad 24 and is tangential to the bowling lane surface 20, along a line designated in FIG. 3 as point 36. As illustrated in FIGS. 3 and 4, in addition to the cloth fabric below the foam pad 24 contacting the lane surface, the cloth fabric around either the roller 34 or roller 22 will also contact the lane surface along a line designated in FIG. 3 or 4 as a point 38 or 40, respectively.

The operator manually pushes on the handle 12 in order to move the lane duster 10 down the length of the bowling lane 20. FIG. 3 shows the forward mode with fabric 30 on the roller bar 22 contacting the surface 20 along line 38 and the fabric 30 below the polyurethane foam pad 24 also contacting lane surface 20 along line 36.

FIG. 2 illustrates a cross section of a bowling lane having a dished lane condition from gutter to gutter across the lane. Surface 20 is slightly concaved at the center of the bowling lane 35. Other lanes are known to have a slightly convex configuration or other minor deviation from a true planar surface. Beneath the tube 23 the foam pad 24 allows the lane duster cloth 30 to conform to the contour of the bowling lane surface 20 in order to increase contact with the lane and to improve dirt removal.

FIG. 3, which is a view transverse to the showing of FIG. 2, shows the surface contact made by the lane duster along lines designated by points 36 and 38 along the lane cloth 30. The lane duster is operated when a bowling center maintenance man pushes the hinged handle 12 in a forward direction 44. The lane duster 10 then slides along the bowling lane surface 20, contacting the lane at lines designated by points 36 and 38.

FIG. 4 shows the lane duster in a return or rearward operation. On a return sweep, the duster may be operated in a rearward direction 46. In the forward mode 44, the fabric 30 beneath roller 22 contacts the lane along line 38 and the fabric 30 below the foam pad 24 contacts the lane surface 20 along line 36. In the rearward mode the frame 11 pivots about pin 16 lifting roller 22 and bringing fabric 30 under roller 34 into contact along line 40. Due to the method of threading fabric 30, the rocking of the duster 10 allows both sides of fabric cloth 30 to be used in the dusting operation. That is, one side of the fabric 30 contacts the surface 20 at 38 and the other side of the fabric contacts the surface 20 at 36 and 40.

Figure 5:
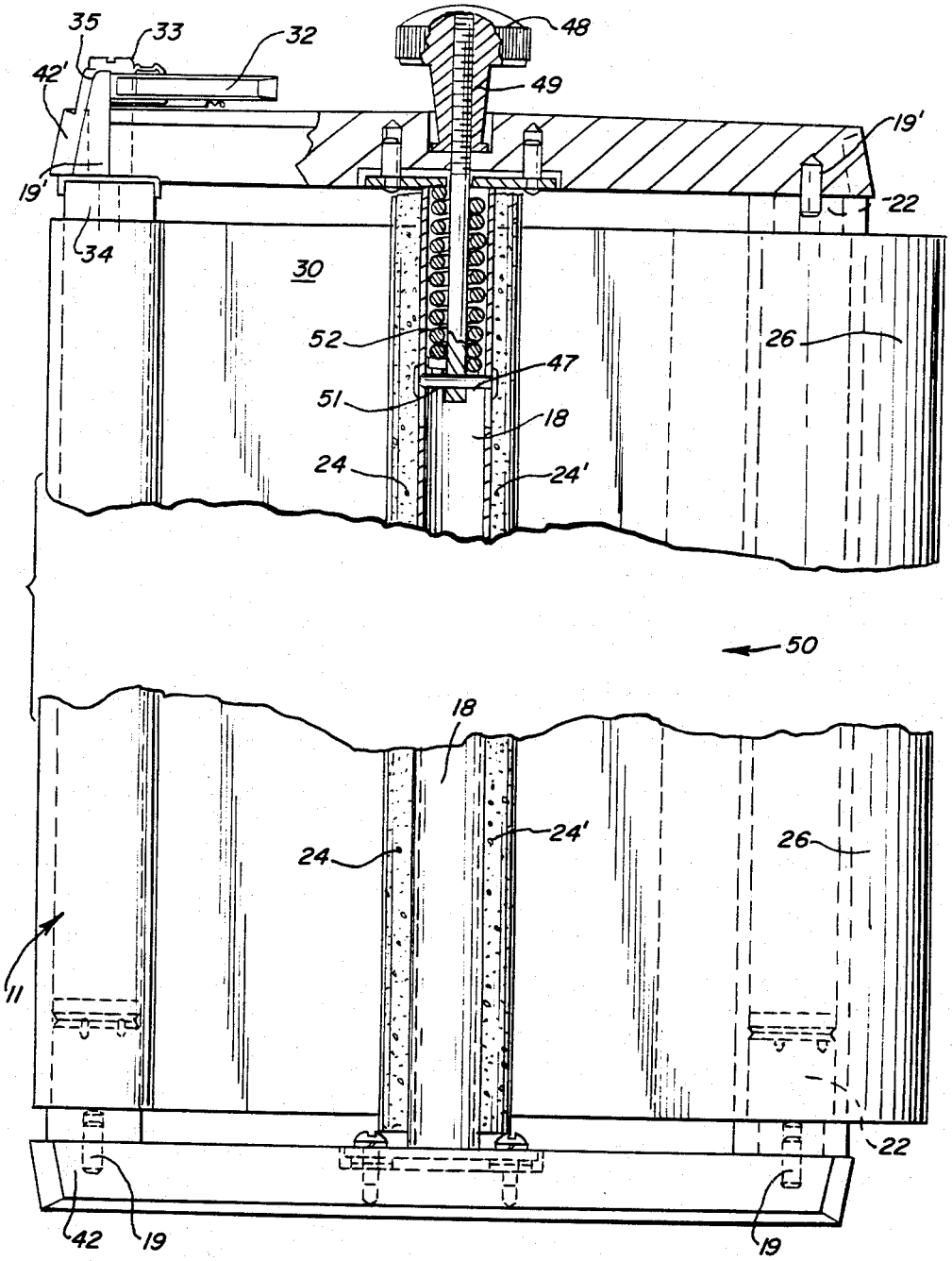
FIG. 5 is a plan view of the lane duster partially in cross section and fragmented.

FIG. 5 shows a planar view of a partial cross sectioned frame 11. Fabric cloth 30 is stretched from cloth fabric roll 26 on roller 22 rearward under spacer bar 18, foam pad 24 and back to take-up roller 34. The tension on fabric cloth 30 is maintained by tightening hand knob 48 to increase resistance to turning the rollers 22, 34 and by actuating the ratchet 33. Tightening the knob 48 moves end casting 42' inward against the axle of roller 22 to resist rotation of roller 22 so that as the ratchet 33 rolls the cloth on roller 34 against the resistance of the roller 22 to rotate, the cloth is tightened between the rollers and over the foam pad 24. When lever 32 is locked in the position shown in FIG. 3, the cloth fabric 30 remains in place and will not slip or roll with the ordinary operation of the duster 10. When the ratchet lever 32 is pivoted clockwise in FIG. 3, cloth fabric 30 is pulled from roller 32 and moves rearward and is wound up on roller 34 so that a new clean piece of fabric 30 tangentially interfaces with bowling lane surface 20. The polyethylene film 28 surrounding the foam pad 24 eases the slide between fabric cloth 30 and foam pad 24 when the cloth 30 is ratcheted rearward by ratchet lever 32 as fabric cloth 30 is rolled up onto take-up roll 34.

It may be noted that it may be desirable to market the foam pad convered lower bar 24 as an accessory attachment to a current model lane duster. For this purpose, a pair of U-clamps and nuts and bolts 54 may be provided to accommodate this function. The U-clamps are dropped over bar 18 and are then bolted to the plate on the tube 23. Alternatively, an accessory kit may be manufactured which exchanges the conventional spacer bar with a spacer bar 18 pre-attached to a foam padded bar 24. The customer who already owns a conventional lane duster, such as the Brunswick (registered trademark) lane duster, may simply remove his conventional spacer bar and replace it with a spacer bar 18-foam padded tube 23 assembly.

It will be understood that the invention may be embodied in other specific forms without departing from the spirit or central characteristics thereof. For example, a lane duster may be conceived using more than one foam pad or more than 2 rollers. The present examples and embodiments, therefore, are to be considered and the invention is not to be limited to the details given herein.

We claim:

1. A lane duster, comprising:

a frame having a pair of spaced apart roller bars;

a center bar on the frame lying parallel to and located between the roller bars, the center bar having a handle pivot-hinged thereto;

pad means carried by the center bar and projecting below the plane of the roller bars, said pad means having a curved, downwardly facing surface and a foam covering on said downwardly facing surface;

one of the roller bars having a roll of cloth fabric wound therearound with the free end of the fabric being threaded below the pad means and onto the other roller bar, said pad means deforming so that the cloth fabric disposed below the pad means is continuously contacting and conforming to a bowling lane surface; and the frame being pivoted about the line of contact of the pad means with the lane surface to selectively contact the fabric below one or the other of the roller bars with the lane surface to accommodate movement of the duster in opposite directions, said curved, downwardly facing surface maintaining the foam covering in contact with the bowling lane surface as the frame is pivoted and permitting effective lane dusting in each of said opposite directions.

2. A lane duster, comprising:

a frame having a pair of spaced apart roller bars;

a center bar on the frame lying parallel to and located between the roller bars, the center bar having a handle pivot-hinged thereto;

pad means carried by the center bar and projecting below the plane of the roller bars, said pad means comprising a polyurethane foam covered by a polyethylene film;

one of the roller bars having a roll of cloth fabric wound therearound with the free end of the fabric being threaded below the pad means and onto the other roller bar, said pad means deforming so that the cloth fabric disposed below the pad means is continuously contacting and conforming to a bowling lane surface; and the frame being pivoted about the line of contact of the pad means with the surface to selectively contact the fabric below one or the other of the roller bars with the surface to accommodate movement of the duster in opposite directions.

3. A lane duster, comprising in combination:

a frame comprising first and second spaced cloth fabric covered roller bars;

a spacer bar on said frame and hinge connected to a handle;

a cylindrical tube carried by and disposed beneath the spacer bar, between the first and second roller bars, below the plane of the first and second roller bars and having a peripheral surface;

a foam pad means substantially surrounding the peripheral surface of the tube; and means for disposing the cloth fabric from one roller bar under said foam pad and back to another of said roller bars;

said foam pad means conforming to the contour of a lane surface to continuously contact the cloth fabric with the surface, said cylindrical tube serving as a pivot about which the frame is moved to selectively bring one or the other of the first and second spaced roller bars into contact with the lane surface, said frame movable in opposite directions to effectively dust the lane in either of said opposite directions by reason of the cylindrical configuration of the tube and the peripheral disposition of the foam pad means on the tube.

4. A lane duster as in claim 3, wherein the cloth fabric below said foam pad means and the cloth fabric covering at least one roller bar is in contact with a bowling lane surface.

5. A lane duster, comprising, in combination, a frame, a handle hinged to the frame, spaced rollers having a cloth fabric wound thereon and being stretched there between, said rollers being capable of selective contact with a bowling lane surface;

wherein the improvement comprising:

pad means carried by said frame, said cloth fabric stretched between said rollers interfacing between said pad means and said lane surface, in contact along with said one of said rollers with said lane surface;

said pad means conforming to the contour of a lane surface to continuously contact the cloth fabric with the surface; and a friction reducing film on said pad means.

6. A lane duster comprising:

a rectangularly shaped frame having a central spacer bar and a pair of end castings, a handle hinged to said central spacer bar for connecting the handle to the frame;

said frame further comprising roller bars for carrying rolled cloth fabric for use in cleaning the surface of a bowling lane;

said frame having a span of at least the width of a bowling lane;

hand-operable means for placing tension on at least one of said rollers to prevent slipping or override of the cloth fabric during a cleaning operation;

ratchet means associated with at least one of said rollers and operable in rotating the one roller for exposing new areas of fabric cloth for cleaning use;

a lower bar attachment structured just below the central spacer bar, covered with a polyurethane foam pad covered by a polyethylene film, whereby the cloth fabric may conform according to the contour of a bowling land surface to be cleaned;

said lane duster means further comprising dual wiper capacity whereby said lower lower bar and at least one of said cloth rollers contact the lane surface for cleaning.

7. A cleaning apparatus having a frame comprised of a pair of end castings connected to each other by a transversely disposed spacer bar, a handle hinged to said spacer bar, a pair of roller bars fixedly secured to said end castings, means on one of said end castings for applying resistance to rotation of one of said roller bars, means on one of said end castings operatively connected to the other of said roller bars for applying incremental turning movement to said other roller bar, surface conforming means carried by the frame and extending below the plane of the roller bars, and fabric means wound on the one roller bar and extending below said surface conforming means and extending to the other roller bar, whereby the fabric below said surface conforming means conforms to a surface being cleaned and whereby the fabric below one or the other roller bars also contacts and cleans said surface.

8. Apparatus for use in cleaning bowling lanes and the like comprising:

a rockable frame;

a pair of transversely extending rollers carried by said frame in laterally spaced apart relationship;

a web of absorbent material stretched between said rollers and coiled around the same in such a manner that as one of the rollers is rotated to coil up the web, the other roller pays out the web to the one roller;

means for releasably retaining the rollers in selected rotative positions;

a web-engaging fulcrum carried by said frame between said rollers in offset relationship with an imaginary line intersecting the peripheries of the web coils around said rollers whereby the frame may be rocked fore-and-aft about said fulcrum to selectively bring either of said web coils and the fulcrum-engaged portion of the web to bear against the lane surface; and means for rocking the frame about said fulcrum in one direction when the frame is moved forwardly along the lane surface and for rocking the frame in the opposite direction about the fulcrum when the frame is moved reversely along the lane surface.

9. Apparatus as claimed in claim 8 wherein said rocking means includes means for applying a force to the frame for moving the same along the lane surface at a point on the frame normally spaced above said fulcrum.

10. Apparatus as claimed in claim 8 wherein said rocking means includes an elongated push-pull handle coupled with the frame.

11. Apparatus as claimed in claim 10 wherein said handle is coupled to the frame at a point normally spaced above said fulcrum to present a moment arm about the fulcrum.

12. Apparatus as claimed in claim 11 wherein said coupling of the handle to the frame includes means for permitting the handle to pivot about a transverse axis.

13. Apparatus for use in cleaning bowling lanes and the like comprising:

a rockable frame;

a pair of transversely extending rollers carried by said frame in laterally spaced apart relationship;

a web of absorbent material stretched between said rollers and coiled around the same in such a manner that as one of the rollers is rotated to coil up the web, the other roller pays out the web to the one roller;

means for releasably retaining the rollers in selected rotative positions;

a web-engaging fulcrum carried by said frame between said rollers in offset relationship with an imaginary line intersecting the peripheries of the web coils around said rollers whereby the frame may be rocked fore-and-aft about said fulcrum to selectively bring either of said web coils and the fulcrum-engaged portion of the web to bear against the lane surface;

said fulcrum comprising a relatively soft, resilient, curved, downwardly facing surface; and means for rocking the frame about said fulcrum in one direction when the frame is moved forwardly along the lane surface and for rocking the frame in the opposite direction about the fulcrum when the frame is moved reversely along the lane surface.

14. Apparatus for use in cleaning bowling lanes and the like comprising:

a rockable frame comprising a pair of elongated end members connected to each other by a transversely disposed spacer means;

a pair of transversely extending rollers carried by said frame in laterally spaced apart relationship;

a web of absorbent material stretched between said rollers and coiled around the same in such a manner that as one of the rollers is rotated to coil up the web, the other roller pays out the web to the one roller;

means for releasably retaining the rollers in selected rotative positions;

a web-engaging fulcrum carried by said frame between said rollers in offset relationship with an imaginary line intersecting the peripheries of the web coils around said rollers whereby the frame may be rocked fore-and-aft about said fulcrum to selectively bring either of said web coils and the fulcrum-engaged portion of the web to bear against the lane surface; and handle means coupled to said spacer means to pivot about a transverse axis for rocking the frame about said fulcrum in one direction when the frame is moved forwardly along the lane surface and for rocking the frame in the opposite direction about the fulcrum when the frame is moved reversely along the lane surface.

15. Apparatus for use in cleaning bowling lanes and the like comprising:

a rockable frame comprising a pair of elongated end members connected to each other by a transversely disposed spacer means;

a pair of transversely extending rollers carried by said frame in laterally spaced apart relationship;

a web of absorbent material stretched between said rollers and coiled around the same in such a manner that as one of the rollers is rotated to coil up the web, the other roller pays out the web to the one roller;

means for releasably retaining the rollers in selected rotative positions comprising means on said end members for applying resistance to rotation of said pair of rollers;

a web-engaging fulcrum carried by said frame between said rollers in offset relationship with an imaginary line intersecting the peripheries of the web coils around said rollers whereby the frame may be rocked fore-and-aft about said fulcrum to selectively bring either of said web coils and the fulcrum-engaged portion of the web to bear against the lane surface; and means for rocking the frame about said fulcrum in one direction when the frame is moved forwardly along the lane surface and for rocking the frame in the opposite direction about the fulcrum when the frame is moved reversely along the lane surface.

* * * * *